US010821316B2

(12) United States Patent
Gore et al.

(10) Patent No.: US 10,821,316 B2
(45) Date of Patent: Nov. 3, 2020

(54) LEG PRESS WITH ADJUSTABLE RESISTANCE RATIO

(71) Applicant: Recreation Supply, Inc., Lewis Center, OH (US)

(72) Inventors: Alan Gore, Lewis Center, OH (US); Jon Wolf, Centerburg, OH (US)

(73) Assignee: RECREATION SUPPLY, INC, Lewis Center, OH (US)

( * ) Notice: Subject to any disclaimer, the term of this patent is extended or adjusted under 35 U.S.C. 154(b) by 74 days.

(21) Appl. No.: 16/166,947

(22) Filed: Oct. 22, 2018

(65) Prior Publication Data

US 2020/0121971 A1 Apr. 23, 2020

(51) Int. Cl.

*A63B 21/062* (2006.01)
*A63B 23/04* (2006.01)
*A63B 21/00* (2006.01)

(52) U.S. Cl.

CPC ..... *A63B 21/063* (2015.10); *A63B 21/0632* (2015.10); *A63B 21/154* (2013.01); *A63B 21/4034* (2015.10); *A63B 21/4047* (2015.10); *A63B 23/0405* (2013.01)

(58) Field of Classification Search

CPC ..... A63B 21/4047; A63B 21/063; A63B 21/0632; A63B 21/4034; A63B 21/0405; A63B 21/154

See application file for complete search history.

(56) References Cited

U.S. PATENT DOCUMENTS 5,366,432 A * 11/1994 Habing ..... A63B 21/06 482/100

7,749,143 B2 * 7/2010 Webber ..... A63B 21/156 482/138

OTHER PUBLICATIONS

Galenaleg PDF Date Mar. 25, 2015 (Wayback Machine https://web.archive.Org/web/20150325055504/https://www.bodycraft.com/product-manuals.html) (Year: 2015).*

* cited by examiner

*Primary Examiner* — Loan B Jimenez
*Assistant Examiner* — Andrew M Kobylarz

(57) ABSTRACT

An exercise machine for performing a leg press exercise includes a resistance device and a plate configured to receive a user's feet during the leg press exercise. An adjustable resistance attachment device is mechanically coupled to the plate and is be selectively coupled to an adjustable resistance attachment device. One or more cables mechanically couple the adjustable resistance device to the resistance device to define a resistance ratio. Attachment of the adjustable resistance device to the adjustable resistance attachment device results in an increase of the resistance ratio for the machine.

20 Claims, 11 Drawing Sheets

LEG PRESS WITH ADJUSTABLE RESISTANCE RATIO

CROSS-REFERENCE TO RELATED APPLICATION(S)

This application makes no priority claim.

TECHNICAL FIELD

Exemplary embodiments of the present invention relate generally to a system and method for a leg press with an adjustable resistance ratio.

BACKGROUND AND SUMMARY OF THE INVENTION

The leg press is a weight training exercise in which a user pushes a weight, or otherwise engages resistance, while moving their legs away from their body. Often this movement is performed as a squat-like motion. Performed properly, this exercise may engage, inter alia, the quadriceps, hamstrings, gluteus maximus, and the calves. The leg press can be used to assess overall lower body strength, particularly from the knee joint to the hip. Often, the leg press is performed using a machine. The machine may comprise a resistance device mechanically coupled to a plate. The user may engage the plate with his or her feet and push it away from him/her to engage the resistance device and perform the exercise. The mechanical coupling may provide a resistance ratio between the resistance device and the plate.

The strength of users varies greatly. Some users are not able to leg press their body weight (e.g., less than 100 lbs.). Others are able to lift several multiples of their body weight (e.g., 300+ lbs.). To accommodate the large variation in user abilities, and because the resistance ratio is fixed by the design of the machine, typically a large range of resistance options must be provided. This generally requires a large weight stack with many different weight increments (e.g., 5, 10, 20, 50, etc. lbs.) or several different resistance devices of different resistance increments (e.g., 50, 100, 150, etc. lbs.). However, it is costly to design, manufacture, and transport such a large and diversified weight stack or resistance device. Therefore, what is needed is a leg press machine with an adjustable resistance ratio.

The present invention is a leg press machine with an adjustable resistance ratio. A rail may extend above a base. A first and second member may extend from the base to the rail. A seat may be adjustably mounted to the rail. Alternatively, or in addition, an adjustable seat back may be provided. A first and second vertical member may be pivotably mounted to the base. The first and second vertical members may be attached to a plate by way of a connector. The plate may be configured to receive a user's feet during the leg press exercise. A first cable may be attached to a resistance device at a first end thereof and a cable termination device on a second end thereof. The first cable may engage a floating pulley. A second cable may be attached to the floating pulley on a first end thereof and a resistance adjustment device on a second end thereof. The second cable may engage a series of pulleys located on one of the support members and one of the vertical members. In other exemplary embodiments, two separate cables may be not required. Instead, a single cable may extend from the resistance adjustment device on a first end thereof, though a series of pulleys, to the resistance device at a send end thereof. Regardless, the resistance adjustment device may be configured to selectively engage a resistance adjustment attachment device. Coupling of the resistance adjustment device and the resistance adjustment attachment device may increase the resistance ratio of the machine. Likewise, decoupling of the resistance adjustment device and the resistance adjustment attachment device may decrease the resistance ratio of the machine.

With the ability to adjust the resistance ratio, a smaller and less diversified weight stack or a fewer number of resistance devices are required to provide a range of resistance options. This may reduce manufacturing complexity, simplify the machine, and reduce transportation costs. It may also result in a machine which takes up a smaller footprint on a gym floor.

Further features and advantages of the devices and systems disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
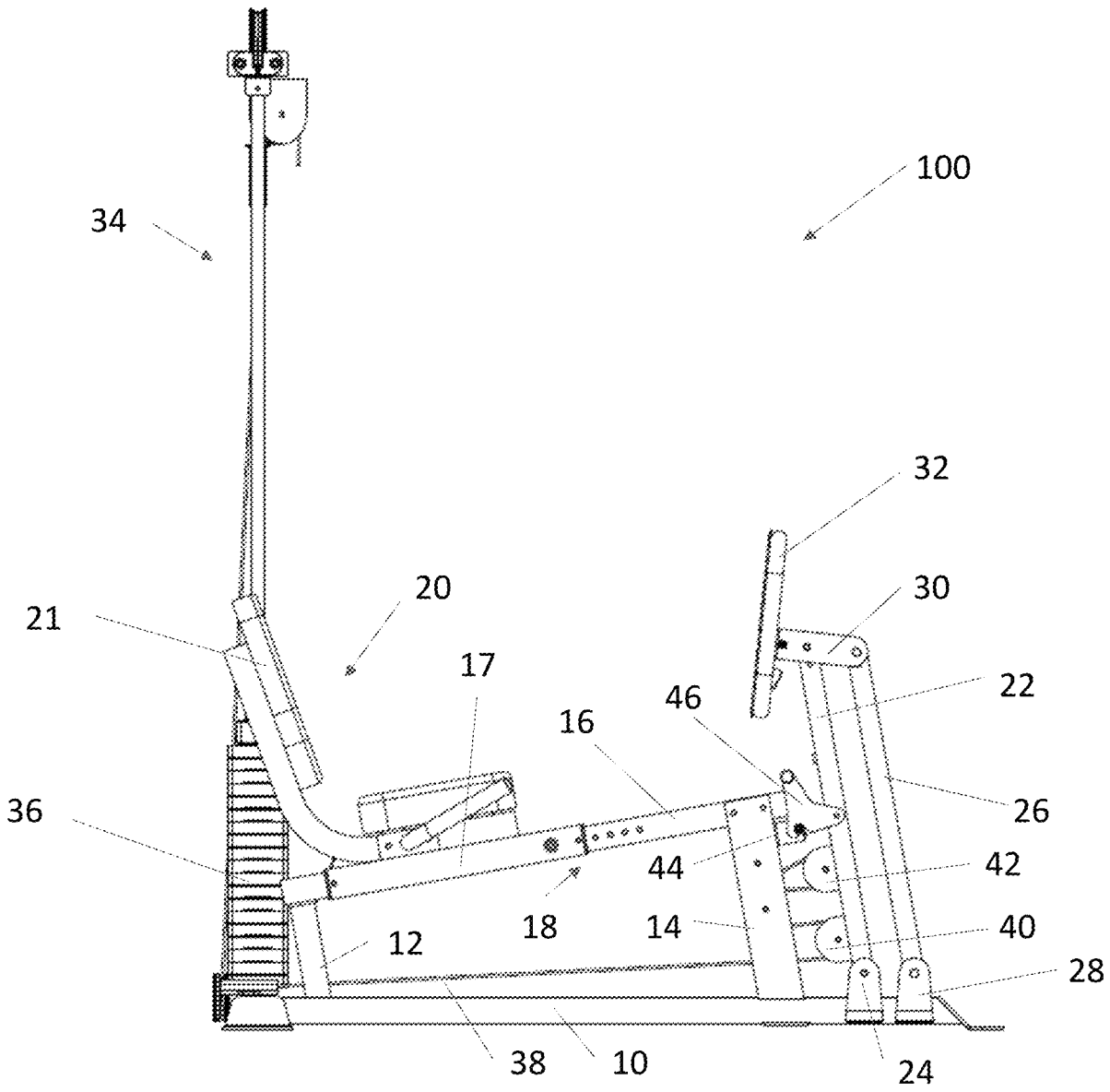
FIG. 1 is a side view of an exemplary leg press machine in accordance with the present invention.
Figure 2:
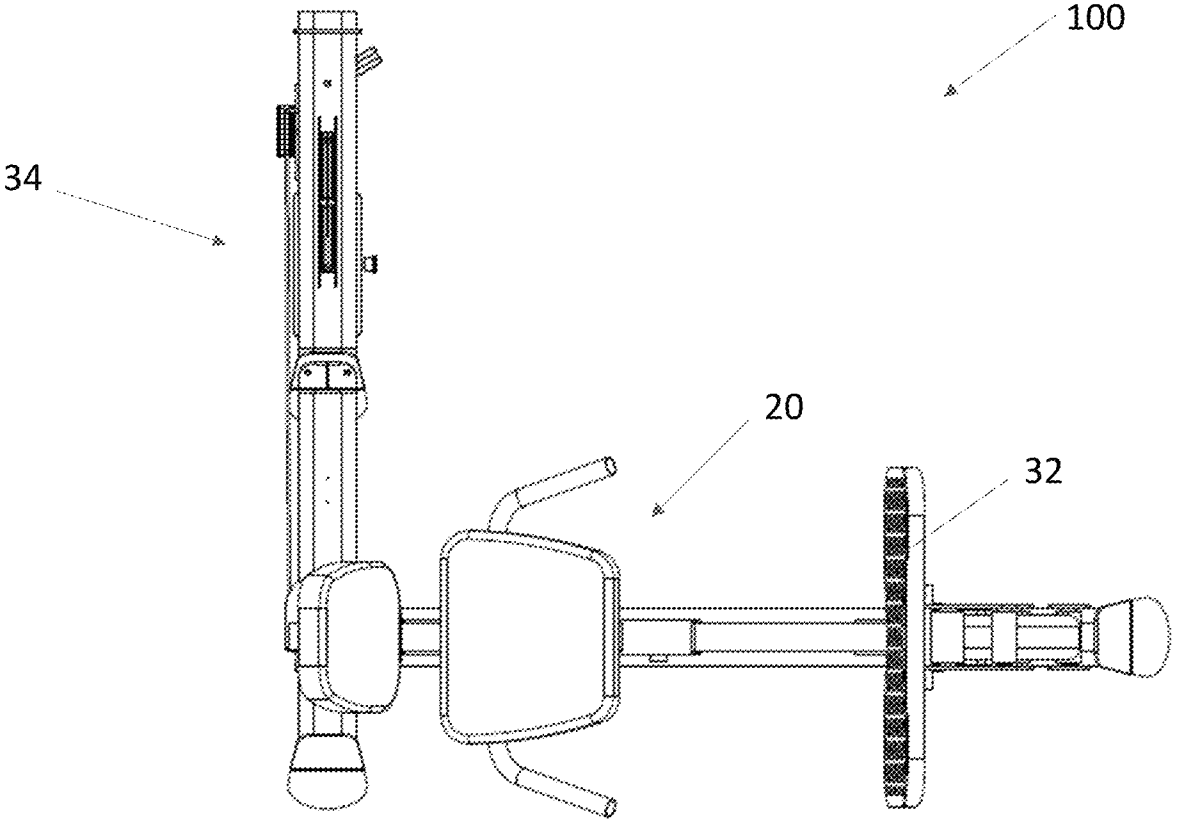
FIG. 2 is a top view of the leg press machine of FIG. 1.
Figure 3:
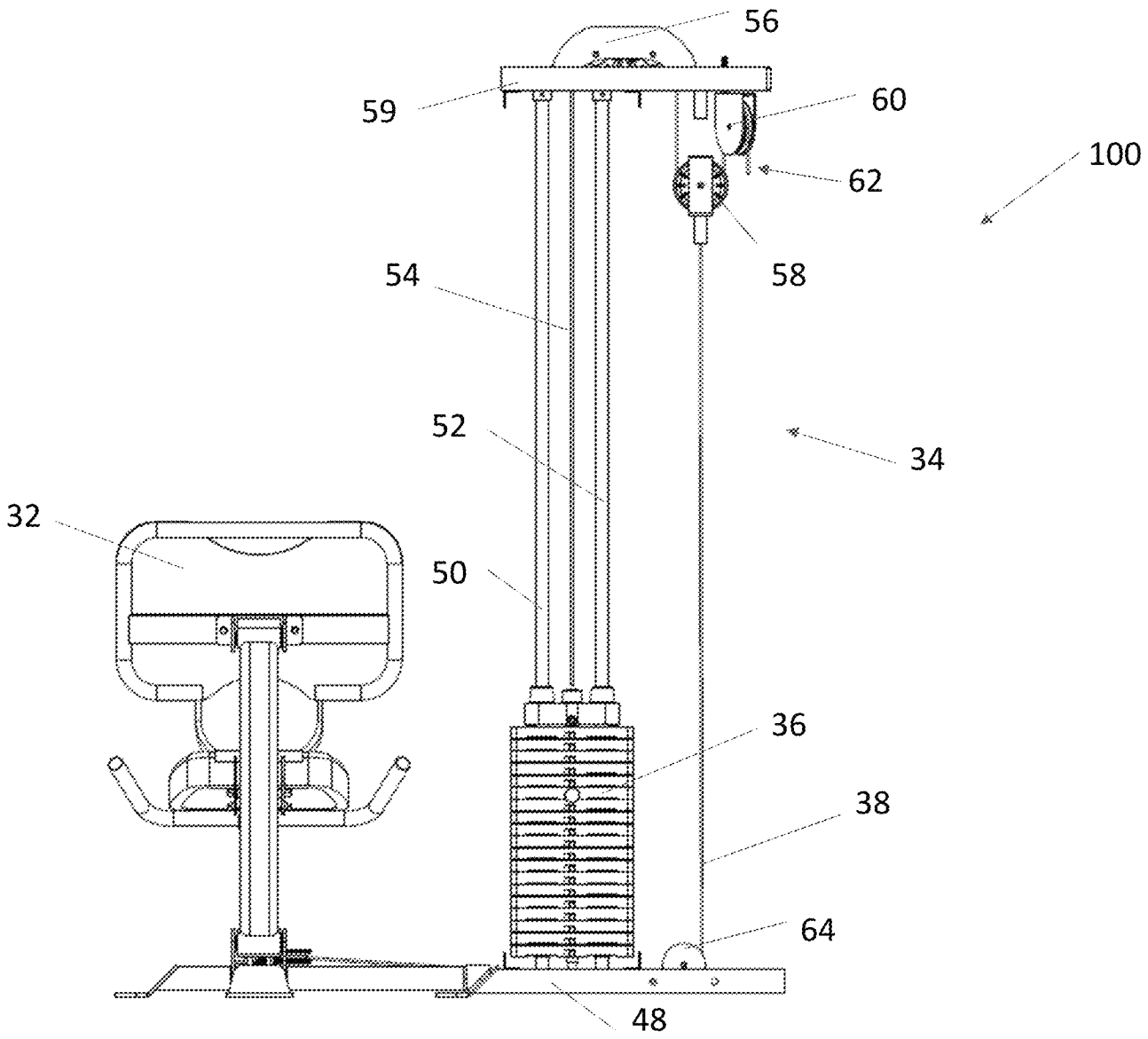
FIG. 3 is a front view of the leg press machine of FIG. 1.
Figure 4:
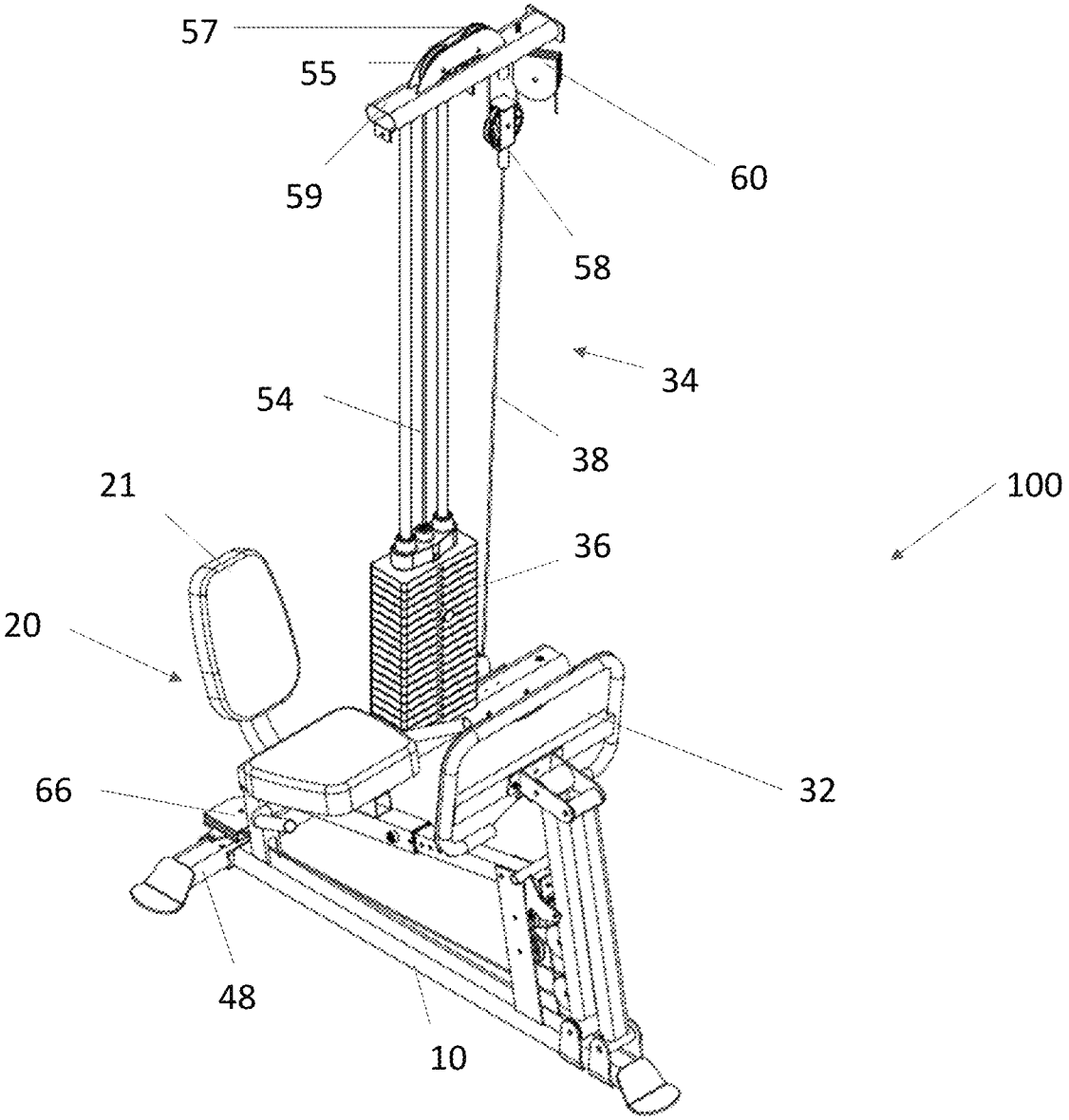
FIG. 4 is a left front perspective view of the leg press machine of FIG. 1.
Figure 5:
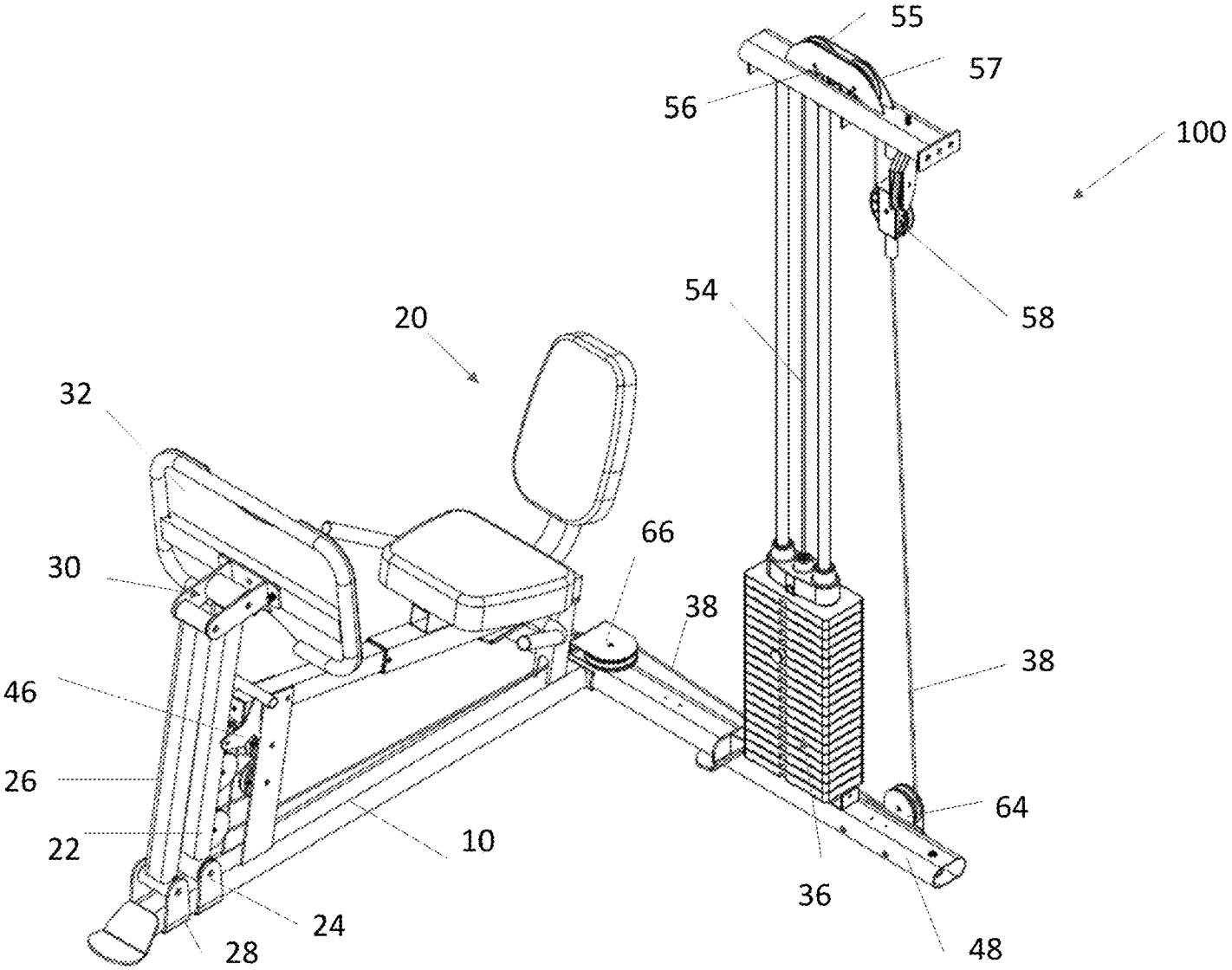
FIG. 5 is a right front perspective view of the leg press machine of FIG. 1.
Figure 6:
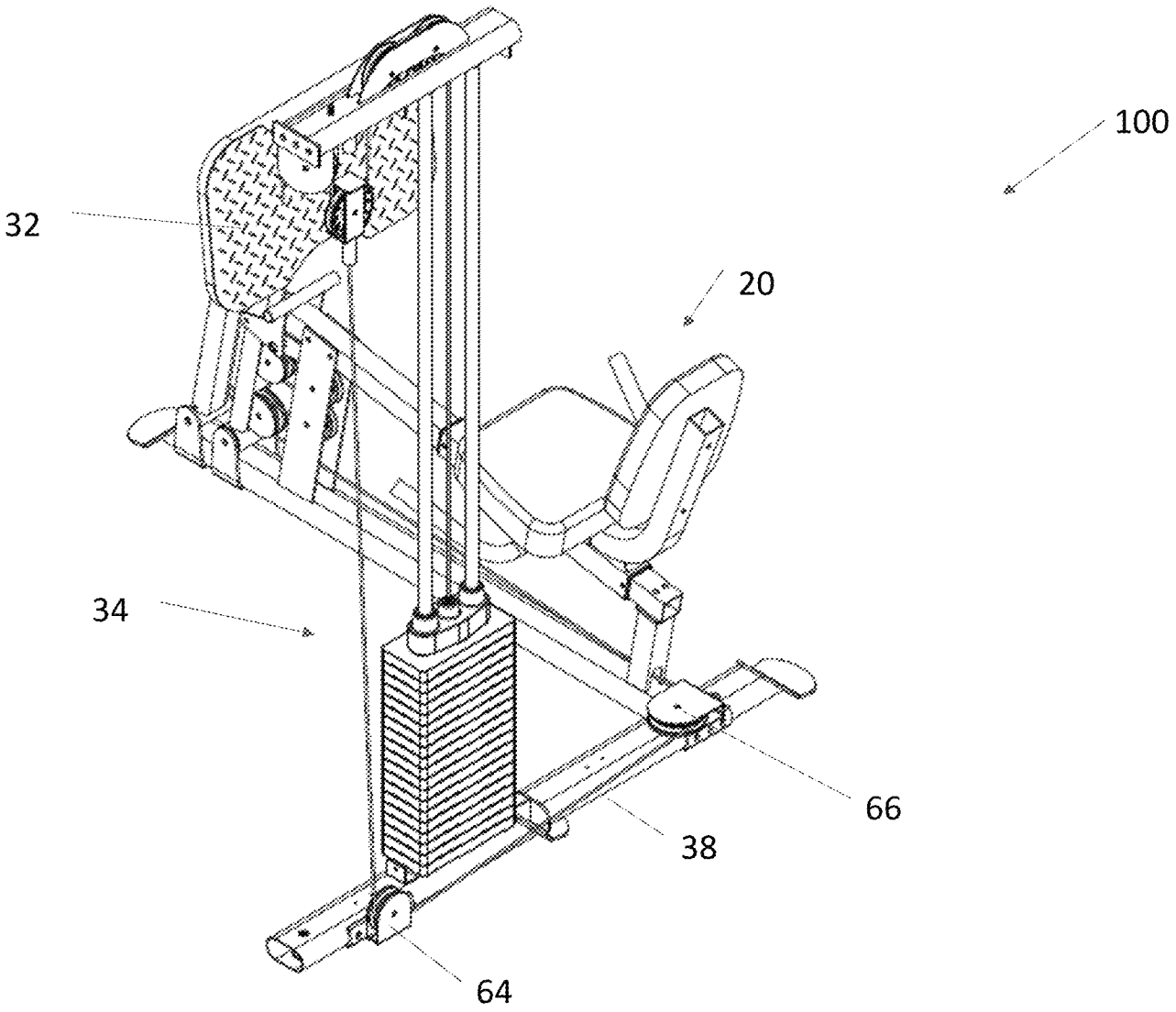
FIG. 6 is a right rear perspective view of the leg press machine of FIG. 1.

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

FIG. 1 through FIG. 8 illustrate various views of an exemplary leg press machine 100. The machine 100 may comprise a base member 10. A first support 12 and a second support 14 may be spaced apart from one another and extend vertically from the base member 10. In exemplary embodiments, the first support 12 may extend from a distal end of the base member 10 while the second support 14 may extend from a proximal end of the base member 10. The first and second supports 12 and 14 may extend at a non-perpendicular angle from the base member 10, though any angle is contemplated. In exemplary embodiments, the first support 12 may have a smaller height than the second support 14, though the reverse, or the same height, is also contemplated.

A rail 16 may be located above the base 10. The first and second supports 12 and 14 may extend from the base 10 to the rail 16. The rail 16 may be attached to and extend between the first and second supports 12 and 14. The rail 16 may be configured to support a seat 20. In exemplary embodiments, the rail 16 may extend at a downward angle from the second support 14 to the first support 12, though any angle is contemplated.

The seat 20 may comprise a seat rail 17, which may be slidably mounted to the rail 16. In exemplary embodiments, the seat rail 17 may be configured to surround the outside of the rail 16, though such is not required. A seat adjustment device 18 may be provided on either or both of the rail 16 and the seat rail 17 and may be configured to selectively secure the seat 20 at various locations along the rail 16. In exemplary embodiments, without limitation, the seat adjustment device 18 may comprise a series of apertures located on the rail 16. The apertures may be configured to receive a pin located on the seat rail 17 for selectively securing the seat 20 at various locations along the rail 16.

Figure 7:
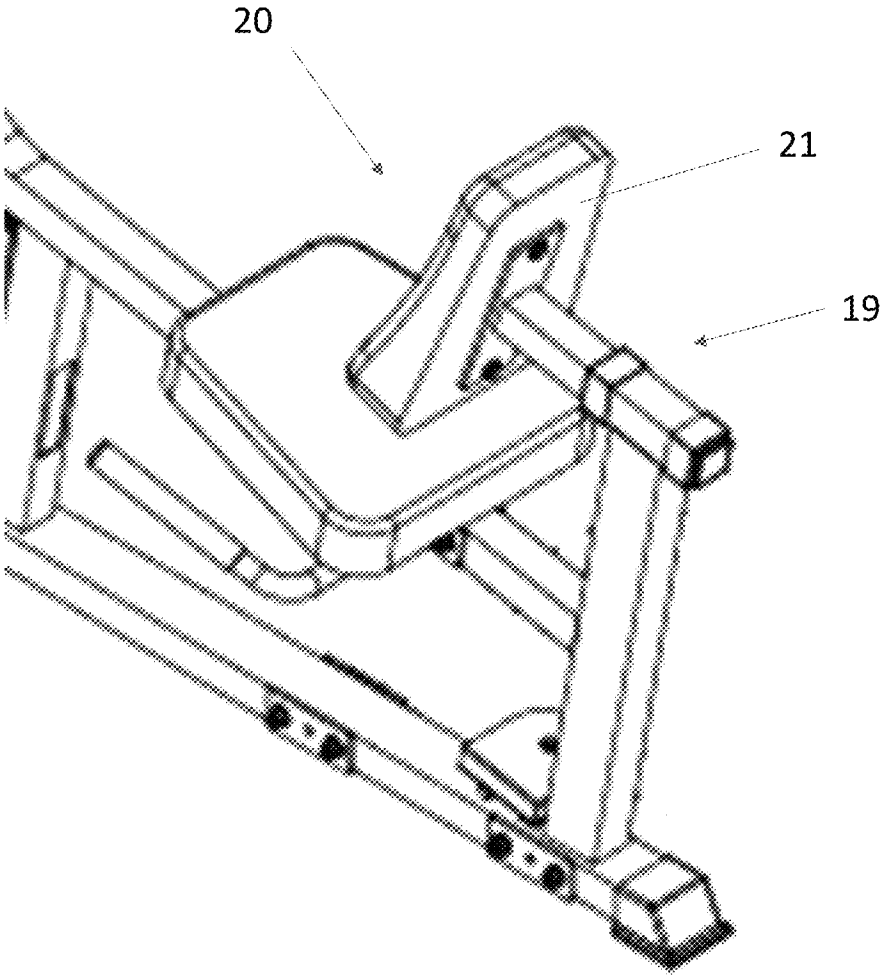
FIG. 7 is a detailed right rear perspective view illustrating another exemplary embodiment of the seat of the leg press machine of FIG. 6.
Figure 8:
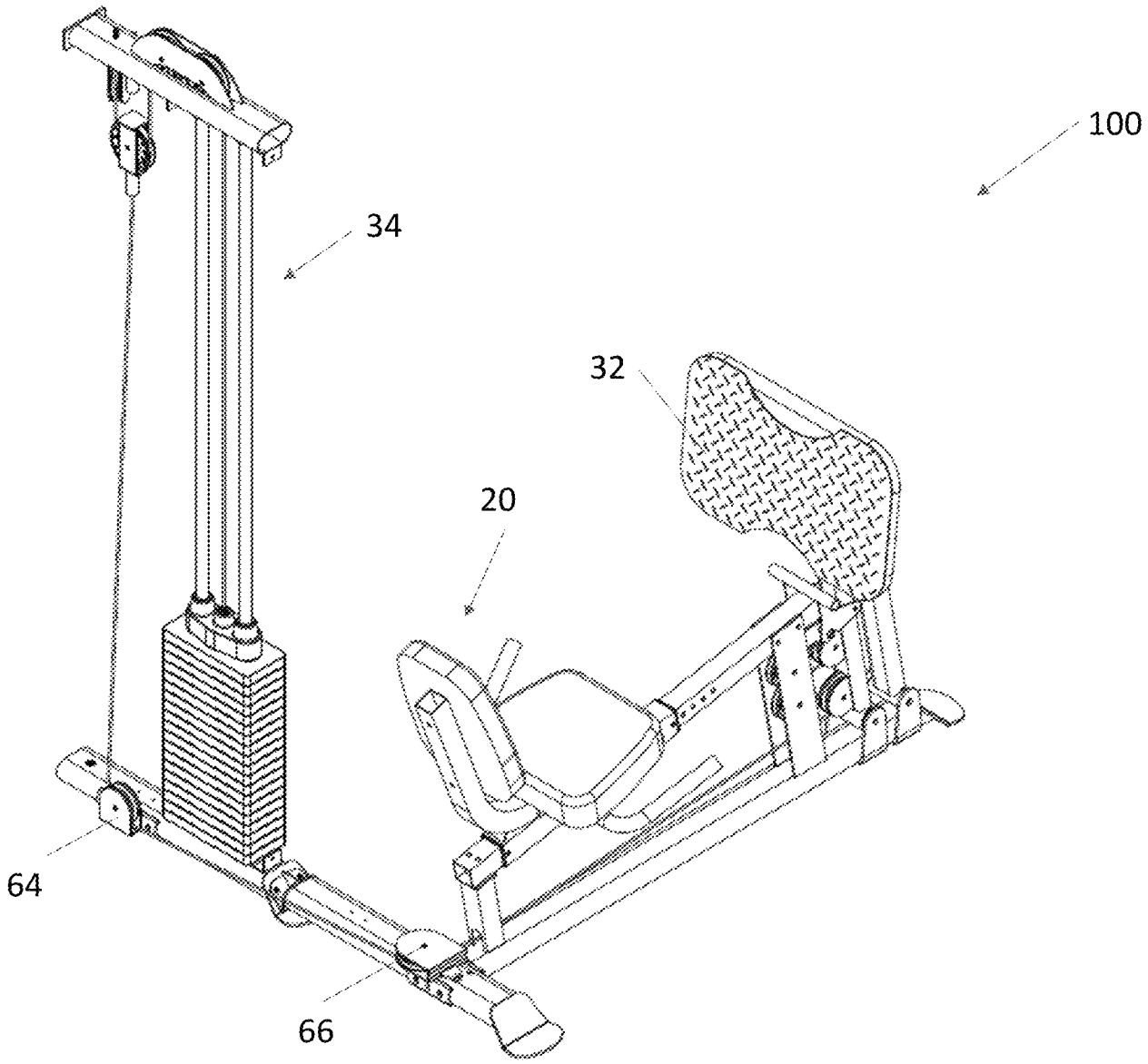
FIG. 8 is a left rear perspective view of the leg press machine of FIG. 1.

In other exemplary embodiments, such as without limitation, those shown in FIG. 7, a seat back 21 of the seat 20 may be adjustably mounted to a seat post 19. The seat post 19 may permit the seat back 21 to move horizontally. The adjustable seat back 21 may be provided in addition to, or instead of, the seat adjustment device 18.

A first end of a first vertical member 22 may be pivotally mounted to a proximal end of the base member 10 by way of a first pivoting device 24. A first end of a second vertical member 26 may likewise be pivotally mounted to a proximal end of the base member 10 by way of a second pivoting device 28. The second vertical member 26 may be located proximal to the first vertical member 22. Both the first and second vertical members 22 and 26 may be located proximal to the second support member 14. The second ends of the first and second vertical members 22 and 26 may be pivotably attached to a connector 30. The connector 30 may be attached to a plate 32. In exemplary embodiments, the second vertical member 26 may not be required.

A tower 34 may be attached to a distal end of the base member 10. The tower 34 may comprise a resistance device 36. However, it is contemplated that the resistance device 36 may be provided separate from the tower 34 such that the tower 34 is not required. Regardless, the resistance device 36 may be mechanically coupled to the plate 32 as will be described in greater detail herein. As used herein, the term mechanically coupled to may be used to refer to, without limitation, one or more items which are attached, bonded, joined, coupled, connected, united, linked or otherwise linked to one another, directly or indirectly. The plate 32 may be configured to receive the user's feet when performing the leg press. The user may sit in the seat and place his or her feet against the plate 32. The user may then push his or her feet away from himself or herself engage the resistance device 36 and move the plate 32. The mechanical coupling of the resistance device 36 to the plate 32 may define a resistance ratio for the machine 100.

The tower 34 may be mounted to a second base member 48. The second base member 48 may be attached to the distal end of the base member 10 and may extend substantially perpendicular thereto, though such is not required. However, any location or orientation of the second base member 48 is contemplated. In exemplary embodiments, the resistance device 36 may be a weight stack, weight plates (such as, without limitation, Olympic or standard weight plates), a device configured to receive one or more weight plates, an electric motor, a friction imparting mechanism, or the like. However, any resistance imparting mechanism is contemplated.

In exemplary embodiments, the resistance device 36 may be configured to move vertically along a first and second vertical rail 50 and 52. The first and second vertical rails 50 and 52 may extend between the second base member 48 and an upper member 59. The upper member 59 may extend substantially parallel with the second base member 48.

A first cable 54 may extend vertically upwards from the resistance device 36 to a pulley assembly 56 located on the upper member 59. The pulley assembly 56 may comprise a first and second pulley 55 and 57. The first cable 54 may engage the upper left side of the first pulley 55 and then travel horizontally rightwards. The first cable 54 may then engage the upper right side of the second pulley 57 and travel vertically downwards to a third pulley 58. The first cable 54 may engage a lower surface of the third pulley 58 and travel vertically upwards to a fourth pulley 60 mounted to the upper member 59. A cable termination device 62, such as but not limited to a ball, grip handle, or the like, may be located on a distal end of the first cable 54 such that the first cable 54 is prevented from extending beyond the fourth pulley 60. In other exemplary embodiments, the cable termination device 62 may be a point of attachment to a fixed item, such as, but not limited to, the upper member 59.

In exemplary embodiments, the third pulley 58 may be floating. A first end of a second cable 38 may be attached to the third pulley 58 and may extend vertically downward to a fifth pulley 64 which may be located on the second base 48. The second cable 38 may engage a lower right side of the fifth pulley 64 and extend horizontally along the second base member 48. The second cable 38 may then engage rear left surface of a sixth pulley 66 and then extend substantially horizontal and along the base member 10. The second cable 38 may then engage a series of pulleys and terminating at an adjustable resistance device 44 as further described herein.

In exemplary embodiments, the machine 100 may be attached to an existing resistance device or other exercise machine. For example, without limitation, the machine 100 may be utilized as an attachment to an existing multi-gym. In such embodiments, the tower 34 may not be required and one or more of the cables (such as but not limited to the first and second cable 54 and 38) may instead attach to the resistance device(s) of the existing exercise machine. In other exemplary embodiments, a separate first and second cable 54 and 38 may not be required. Instead, a single cable may extend from the resistance device 36 to the adjustable resistance device 44. Whether one or more than one cables are used, the resistance device 36 may be mechanically coupled to the adjustable resistance device 44.

Figure 9:
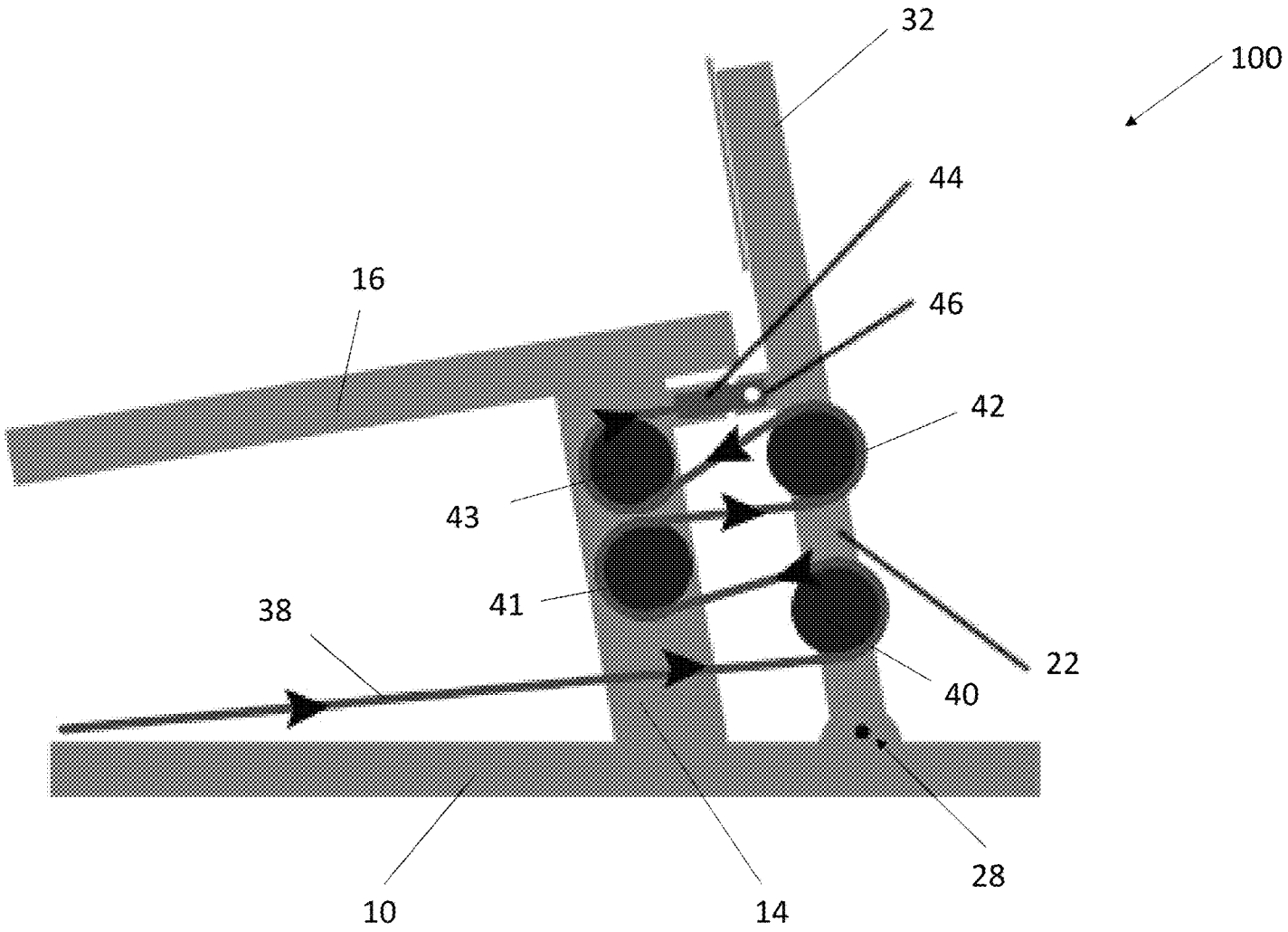
FIG. 9 is a detailed left side sectional view of the leg press machine of FIG. 1 with the adjustable resistance device in an engaged position and the plate in a first position.
Figure 10:
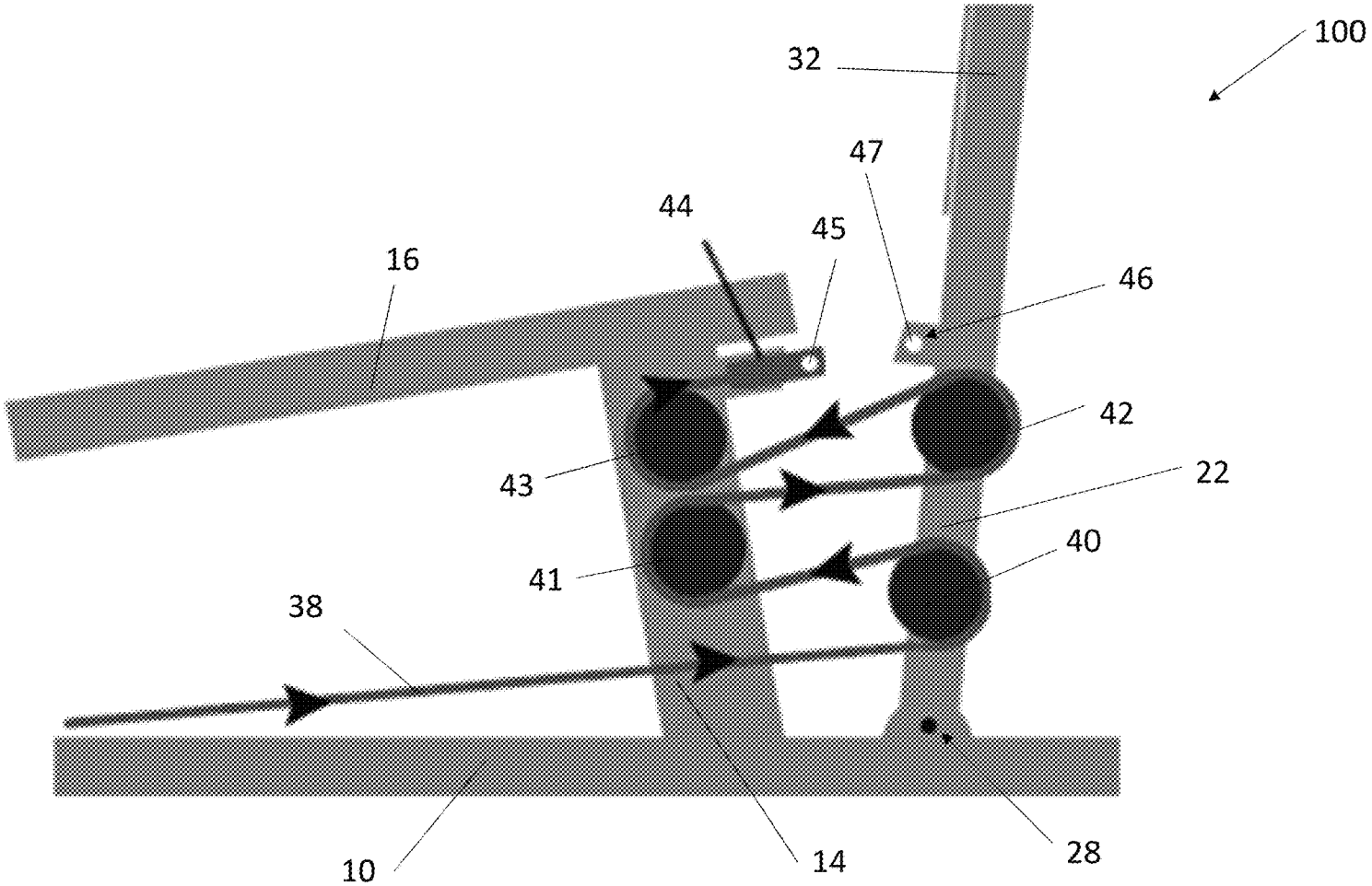
FIG. 10 is a detailed left side sectional view of the leg press machine of FIG. 1 with the adjustable resistance device in a disengaged position and the plate in a second position.
Figure 11:
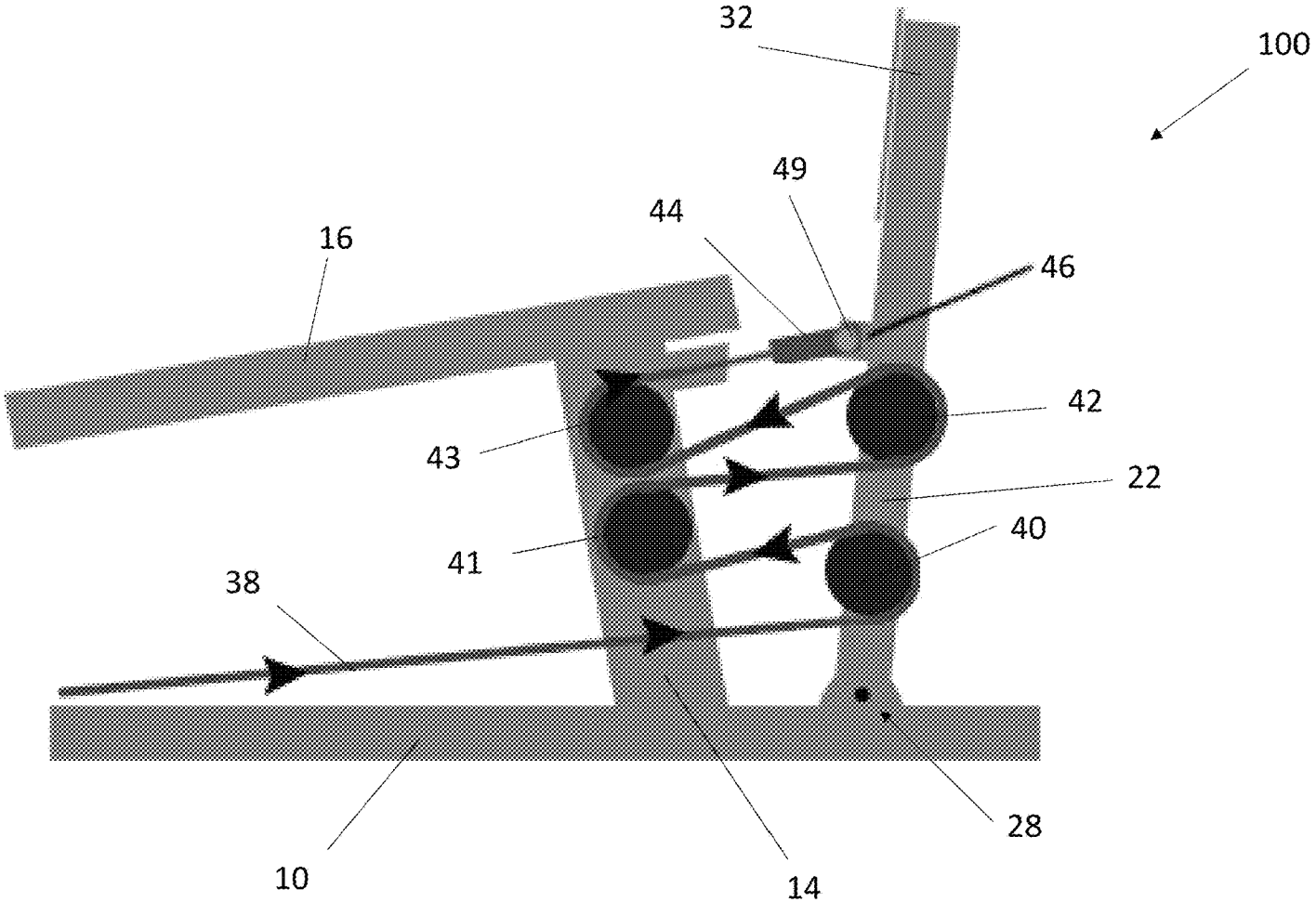
FIG. 11 is a detailed left side sectional view of the leg press machine of FIG. 1 with the adjustable resistance device in an engaged position and the plate in the second position.

FIG. 9 is a detailed left side sectional view of the machine 100 with the adjustable resistance device 44 in an engaged position and the plate 32 in a first position. FIG. 10 is a detailed left side sectional view of the machine 100 with the adjustable resistance device 44 in a disengaged position and the plate 32 in a second position. FIG. 11 is a detailed left side sectional view of the machine 100 with the adjustable resistance device 44 in an engaged position and the plate 32 in the second position.

The second cable 38 may engage a right side of a seventh pulley 40 located on the first vertical member 22. The second cable 38 may travel substantially horizontally to an eighth pulley 41 located on the second support 14. The second cable 38 may engage a left side of the eighth pulley 41 and travel substantially horizontally to a ninth pulley 42 located on the first vertical member 22. The second cable 38 may engage a right side of the ninth pulley 42 and travel substantially horizontally and downward to a tenth pulley 43 located on the second support 14. The second cable 38 may engage a left side of the tenth pulley 43 and extend substantially horizontally and terminate at an adjustable resistance device 44. The adjustable resistance device 44 may be located on the second support 14. Alternatively, or in addition, the adjustable resistance device 44 may be configured to frictionally engage the second support 14. In exemplary embodiments, the tenth pulley 43 may be located above the eighth pulley 41 and the ninth pulley 42 may be located above the seventh pulley 40.

While the travel of the second cable 38 through the aforementioned pulleys may be described as substantially horizontal, those of skill in the art will realize that any angle and direction of travel is contemplated. Similarly, the number, size, and arrangement of the aforementioned pulleys may be varied. The number, size, and arrangement of the pulleys may affect the resistance ratio of the machine 100. As such, the number, size, and arrangement of the pulleys, inter alia, may be selected to impart a particular resistance ratio for the machine 100.

It is contemplated that the second cable 38 may instead be attached to the resistance device 36. In such embodiments, the floating pulley 58, the fourth pulley 60, and the first cable 54 may not be required. The second cable 38 may instead engage the first and second pulleys 55 and 57 of the pulley assembly 56. In this way, the second cable 38 may extend from the adjustable resistance device 44 on a first end thereof, to the resistance device 36 on a second end thereof.

The adjustable resistance device 44 may be configured for selective attachment to an adjustable resistance attachment device 46. The adjustable resistance attachment device 46 may be mechanically coupled to the plate 32. For example, without limitation, the adjustable resistance attachment device 46 may be attached to or located on the first vertical member 22, which may be mechanically coupled to the plate 32. The adjustable resistance device 44 may be configured such that it may not be retracted beyond the second support 14 and/or the tenth pulley 43. The adjustable resistance device 44 may be a handle, knob, ball, member, or the like. In exemplary embodiments, the adjustable resistance device 44 may be pivotally attached to the second support 14. Regardless, the adjustable resistance device 44 may be configured for selective engagement with the adjustable resistance attachment device 46.

Upon coupling of the adjustable resistance device 44 and the adjustable resistance attachment device 46, the resistance ratio of the machine 100 may be increased. Similarly, upon decoupling of the adjustable resistance device 44 and the adjustable resistance attachment device 46, the resistance ratio of the machine 100 may be decreased. In exemplary embodiments, without limitation, the resistance ratio of the machine 100 may be approximately 1:2 when the adjustable resistance device 44 is not coupled to the adjustable resistance attachment device 46 and the resistance ratio of the machine 100 may be approximately 1:3 when the adjustable resistance device 44 is coupled to the adjustable resistance attachment device 46. Stated another way, when the resistance ratio is set to approximately 1:2, for every 1 lb. of force imparted by the resistance device, the user may experience 2 lbs. of resistance at the plate. Likewise, when the resistance ratio is set to approximately 1:3, for every 1 lb. of force imparted by the resistance device, the user may experience 3 lbs. of resistance at the plate. As those of skill in the art will recognize, these ratios are merely exemplary and are not intended to be limiting. Any resistance ratios, with or without coupling of the adjustable resistance device 44 to the adjustable resistance attachment device 46, are contemplated.

As those of skill in the art will recognize, the increase in the resistance ratio when the adjustable resistance device 44 is coupled to the adjustable resistance attachment device 46 is due, at least in part, to the elevation of the point of resistance experienced by the user. Stated another way, when the adjustable resistance device 44 is coupled to the adjustable resistance attachment device 46, the point of resistance is moved upwards and away from the fulcrum point. Similarly, the resistance ratio is decreased when the adjustable resistance device 44 is not coupled to the adjustable resistance attachment device 46 due to the lowering of the elevation of the point of resistance experienced by the user. Stated another way, when the adjustable resistance device 44 is not coupled to the adjustable resistance attachment device 46, the point of resistance is moved downward and towards from the fulcrum point.

In one exemplary embodiment, the adjustable resistance device 44 may be a handle configured to selectively receive a corresponding protrusion or slot located in the adjustable resistance attachment device 46. In another exemplary embodiment, the adjustable resistance attachment device 46 is a handle and the adjustable resistance device 44 comprises a slot or protrusion configured to be selectively received by said handle. In other exemplary embodiments, the adjustable resistance device 44 may be a member comprising an aperture 45 for a pin 49. Similarly, the adjustable resistance attachment device 46 may comprise an aperture 47 configured to receive the pin 49. The pin 49 may be extended through the adjustable resistance device 44 and the adjustable resistance attachment device 46 to secure the adjustable resistance device 44 to the adjustable resistance attachment device 46.

Regardless of whether the adjustable resistance device 44 is coupled to the adjustable resistance attachment device 46, the plate 32 may be moved between the first and second positions when the user presses his or her feet against the plate 32 with sufficient force to overcome the resistance provided by the resistance device 36. In this way, the leg press exercise may be performed.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. An exercise machine for performing a leg press exercise comprising:

a resistance device;

a plate configured to receive a user's feet for the leg press exercise;

an adjustable resistance attachment device mechanically coupled to the plate;

an adjustable resistance device configured to be selectively attached to the adjustable resistance attachment device;

one or more pulleys;

one or more cables traveling through the one or more pulleys and mechanically coupling the resistance device to the plate and the adjustable resistance device;

wherein the adjustable resistance device is configured to prevent travel beyond the one or more pulleys such that detachment of the adjustable resistance device from the adjustable resistance attachment device is configure to provide a first, non-zero resistance ration for the leg press exercise;

wherein attachment of the adjustable resistance device to the adjustable resistance attachment device is configured to provide a second, non-zero resistance ratio for the leg press exercise, where the second resistance ratio is greater than the first resistance ratio.

2. The exercise machine of claim 1 further comprising:

a seat;

a rail configured to receive the seat;

a base member located below the rail;

a first and second support member extending from the base member to the rail;

at least one vertical member extending from the base member to the plate; and a series of pulleys configured to receive the one or more cables.

3. The exercise machine of claim 2 wherein:

said series of pulleys comprises a first, second, third, and fourth pulley;

the first and third pulleys are located on one of said at least one vertical members;

the second and fourth pulleys are located on said second support member;

the third pulley is located above said first pulley; and the fourth pulley is located above said second pulley.

4. The exercise machine of claim 3 wherein:

said one or more cables comprises a first cable and a second cable;

said first cable is connected to the resistance device at a first end thereof, engages a floating pulley, and is attached to a cable termination device at a second end thereof;

said second cable is attached to the floating pulley at a first end thereof, engages said series of pulleys, and is attached to the adjustable resistance device at a second end thereof.

5. The exercise machine of claim 4 further comprising:

a tower comprising:

said resistance device, a second base member attached to said base member, an upper member spaced apart from and extending substantially parallel with said second base member, a first and second vertical rail extending between said second base member and said upper member, wherein said first and second vertical rails are configured to receive said resistance device, and a pulley assembly located on said upper member comprising a fifth and sixth pulley, wherein said first cable engages said fifth and sixth pulleys.

6. The exercise machine of claim 4 wherein:

said second cable extends along the base member.

7. The exercise machine of claim 4 further comprising:

a connector, wherein said at least one vertical member comprises a first and second vertical member, and wherein said connector joins said first and second vertical members to one another and to the plate.

8. The exercise machine of claim 2 wherein:

said adjustable resistance device is located at a distal end of said one or more cables; and said adjustable resistance attachment device is located on the same vertical member as the first and third pulleys.

9. The exercise machine of claim 2 further comprising:

a seat rail attached to the seat and slidably mounted to the rail such that the position of the seat may be adjusted along the rail;

an adjustment device configured to selectively secure the seat at a position along the rail; and a seat post configured to permit the horizontal adjustment of a seat back of the seat.

10. The exercise machine of claim 1 wherein:

the resistance device comprises a weight stack.

11. The exercise machine of claim 1 wherein:

the first resistance ratio is substantially 1:2; and the second resistance ratio is substantially 1:3.

12. The exercise machine of claim 1 wherein:

the adjustable resistance attachment device comprises a handle; and the adjustable resistance device comprises a slot or protrusion configured to selectively mate with said handle.

13. The exercise machine of claim 1 wherein:

the adjustable resistance device comprises a handle; and the adjustable resistance attachment device comprises a slot or protrusion configured to selectively mate with said handle.

14. The exercise machine of claim 1 further comprising:

an aperture located in the adjustable resistance device;

a corresponding aperture located in the adjustable resistance attachment device; and a pin sized to extend through the aperture and the corresponding aperture.

15. An exercise machine for performing a leg press exercise comprising:

a base member;

a first support member extending vertically from said base member;

a first vertical member pivotably mounted to said base member;

a plate attached to said first vertical member;

a resistance device;

an adjustable resistance device mechanically coupled to said resistance device and attached to said first support member to define a resistance ratio;

an adjustable resistance attachment device attached to said first vertical member and configured to be selectively coupled to said adjustable resistance device;

a first cable attached to said resistance device at a first end thereof and attached to a cable termination device at a second end thereof, wherein said first cable engages a floating pulley; and a second cable attached to the floating pulley at a first end thereof and attached to the adjustable resistance device at a second end thereof, wherein said second cable engages a set of pulleys;

wherein coupling of the adjustable resistance device to the adjustable resistance attachment device results in an increased resistance ratio.

16. The exercise machine of claim 15 wherein:

said set of pulleys comprises a first, second, third, and fourth pulley;

the first and third pulleys are located on said first vertical member;

the second and fourth pulleys are located on said first support member;

the third pulley is located above said first pulley; and the fourth pulley is located above said second pulley.

17. The exercise machine of claim 15 wherein:

the resistance ratio is substantially 1:2 when the adjustable resistance device is not coupled to the adjustable resistance attachment device; and the resistance ratio is substantially 1:3 when the adjustable resistance device is coupled to the adjustable resistance attachment device.

18. The exercise machine of claim 15 wherein:

the resistance device is configured to receive one or more weight plates.

19. An exercise machine for performing a leg press exercise comprising:

a base member;

a rail located above said base member;

a first and second support member spaced apart from one another and extending from said base member to said rail;

a seat slidably mounted to said rail;

a weight stack;

a first and second vertical member pivotably mounted to said base member;

a connector;

a plate attached to said first and second vertical members by way of said connector, wherein said plate is configured to receive a user's feet during the leg press exercise;

a set of pulleys comprising:

a first pulley located on said first vertical member, a second pulley located on said second support member, a third pulley located on said first vertical member above said first pulley, and a fourth pulley located on said second support member above said second pulley;

a cable termination device;

a floating pulley;

an adjustable resistance device;

a first cable having a first and second end, wherein said first cable is attached to said weight stack at the first end thereof, engages the floating pulley, and is attached to the cable termination device at the second end thereof;

a second cable having a first and second end, wherein said second cable is attached to the floating pulley at the first end thereof, engages each of said set of pulleys, and is attached to the adjustable resistance device on the second end thereof; and an adjustable resistance attachment device configured to be selectively coupled to the adjustable resistance device;

wherein the exercise machine defines a first resistance ratio when the adjustable resistance device is not coupled to the adjustable resistance attachment device;

wherein the exercise machine defines a second resistance ratio when the adjustable resistance device is coupled to the adjustable resistance attachment device;

wherein the second resistance ratio is greater than the first resistance ratio.

20. The exercise machine of claim 1 wherein:

said adjustable resistance device comprises a ball, knob, or member.

* * * * *